US012203699B2

(12) United States Patent
Mudd

(10) Patent No.: US 12,203,699 B2
(45) Date of Patent: Jan. 21, 2025

(54) COLD PLUNGE WATER GENERATION ASSEMBLY FOR A TUB ENCLOSURE WITH HEATING CAPABILIY

(71) Applicant: Riley Mudd, St. Petersburg, FL (US)

(72) Inventor: Riley Mudd, St. Petersburg, FL (US)

( * ) Notice: Subject to any disclaimer, the term of this patent is extended or adjusted under 35 U.S.C. 154(b) by 0 days.

(21) Appl. No.: 18/645,985

(22) Filed: Apr. 25, 2024

(65) Prior Publication Data

US 2024/0393037 A1 Nov. 28, 2024

Related U.S. Application Data

(60) Provisional application No. 63/468,715, filed on May 24, 2023.

(51) Int. Cl.

| | |
|---|---|
| ***F25D 31/00*** | (2006.01) |
| ***E03C 1/04*** | (2006.01) |
| ***F24H 1/10*** | (2022.01) |
| ***F24H 9/13*** | (2022.01) |

(52) U.S. Cl.

CPC ..... *F25D 31/002* (2013.01); *E03C 1/0408* (2013.01); *F24H 1/101* (2013.01); *F24H 9/136* (2022.01)

(58) Field of Classification Search

CPC ..... F25D 31/002; F24H 9/136; F24H 1/101; E03C 1/0408; A61F 7/0053; A61F 2007/0056; A61F 33/0095; A61H 33/0095

See application file for complete search history.

(56) References Cited

U.S. PATENT DOCUMENTS

| | | | |
|---|---|---|---|
| 3,272,201 | A | 9/1966 | Burns |
| 3,411,499 | A | 11/1968 | Jacuzzi |
| 4,149,529 | A | 4/1979 | Copeland |

(Continued)

FOREIGN PATENT DOCUMENTS

| | | | |
|---|---|---|---|
| CN | 219538137 U | * | 8/2023 |
| EP | 2047835 A1 | | 9/2008 |

(Continued)

OTHER PUBLICATIONS

Machine English language translation of CN219538137 to Lu et al. (Year: 2023).*

(Continued)

*Primary Examiner* — Cassey D Bauer

(74) *Attorney, Agent, or Firm* — Johnson | Dalal; Mark C. Johnson

(57) ABSTRACT

A cold plunge water generation assembly for a tub enclosure that is capable of receiving water from an outside water source, chilling said water with an electric water cooling system to a temperature within a range of 33-45° F. and delivering said chilled water to a cold water storage tank for storage. The assembly includes a cold water pump fluidly coupled to the cold water storage tank and an electric controller communicatively coupled to the cold water pump, the electric water cooling system, and an electric display on the assembly, wherein the electric controller is operably configured to selectively initiate the water cooling system to chill incoming liquid for storage in the cold water storage tank and cause the cold water pump to induce a flow of the chilled liquid to the cold water supply conduit and out through the faucet coupled to the tub enclosure.

15 Claims, 4 Drawing Sheets

(56) References Cited

U.S. PATENT DOCUMENTS

| | | | |
|---|---|---|---|
| 4,768,705 | A | 9/1988 | Tsutsui et al. |
| 10,966,410 | B2 | 4/2021 | Zimmerman |
| 2003/0213850 | A1 | 11/2003 | Mayer et al. |
| 2006/0253973 | A1 | 11/2006 | Brooks |
| 2013/0041440 | A1 | 2/2013 | Kingsley et al. |

FOREIGN PATENT DOCUMENTS

| | | | | | |
|---|---|---|---|---|---|
| EP | 4098825 | A1 | | 12/2022 | |
| WO | WO-2021229236 | A1 | * | 11/2021 | ..... A61F 7/00 |

OTHER PUBLICATIONS https://shop.buildahottub.com/product/diy-cold-plunge-plumbing-kit/.
https://plunge.com/pages/setup.

* cited by examiner

COLD PLUNGE WATER GENERATION ASSEMBLY FOR A TUB ENCLOSURE WITH HEATING CAPABILIY

FIELD OF THE INVENTION

The present invention relates to cold water generation systems and methods and, more specifically, a cold water or plunge assembly configured to fluidly and mechanically couple with plumbing for a user's tub enclosure.

BACKGROUND OF THE INVENTION

Cold water immersion via an ice or cold-water plunge is known to carry significant benefits including, without limitation, decreasing inflammation, offering a rush of endorphins, spiking dopamine, improving sleep and mood, reducing stress, remedying aches and pains, boosting injury recovering, and reducing swelling. Traditional forms of setting up an ice or cold-water plunge, however, are logistically challenging and financially burdensome. Specially constructed cold plunge bathtubs can cost thousands of dollars and makeshift, portable ice baths involve significant set-up time and have a greater physical footprint, taking up valuable real estate. Above all, however, each of the existing options require a user to physically carry and bring enough water and/or ice to fill the bathtub, resulting in the expenditure of substantial time and effort to do so (and to subsequently empty and dispose of the melted bath water and/or to break down the portable ice bath structure).

Some known cold plunge water assemblies are standalone structures that have their own stand-alone plumbing or plumbing that requires connection to an outside water source, typically provided from a public utility entity. These known cold plunge water assemblies are generally very expensive and not affordable by most consumers. Additionally, when a component on these known cold plunge water assemblies, the maintenance and repair of said components is also a cost-intensive and time-intensive process.

Therefore, a need exists to overcome the problems with the prior art as discussed above.

SUMMARY OF THE INVENTION

The invention provides a cold plunge water generation assembly for a tub enclosure with heating capability that overcomes the hereinafore-mentioned disadvantages of the heretofore-known devices and methods of this general type and that retrofits a conventional tub enclosure and the plumbing associated therewith. The present invention may also be utilized with household plumbing fixtures that does not include a tub enclosure, e.g., faucets, shower heads, etc., but is particularly focused on providing a user with cold plunge capabilities for a tub enclosure.

With the foregoing and other objects in view, there is provided, in accordance with the invention, a cold plunge water generation assembly that improves on a tub enclosure having a faucet coupled to the tub enclosure, an outside water source, a heat exchange assembly, a hot water supply conduit configured to fluidly couple the outside water source, the heat exchange assembly, and the faucet together, and having a cold water supply conduit configured to fluidly couple the outside water source and the faucet together. The cold plunge water generation assembly includes a base, a housing coupled to the base to form an enclosure, a liquid intake connector fluidly coupled to the outside water source, a cold water storage tank disposed within the enclosure and configured to house a liquid therein, a cold water pump fluidly coupled to the cold water storage tank through a cold water assembly conduit, an electric water cooling system operably configured to chill incoming liquid from the outside water source to a temperature within a range of 33-45° F., an electric display, and an electric controller communicatively coupled to the cold water pump, the electric water cooling system, and the electric display, wherein the electric controller is also operably configured to selectively initiate the water cooling system to chill incoming liquid for storage in the cold water storage tank and cause the cold water pump to induce a flow of the liquid housed within the cold water storage tank and at the temperature range of 33-45° F. to the cold water supply conduit and out through the faucet.

In accordance with a further feature of the present invention, the cold plunge water generation assembly is disposed proximal to the tub enclosure.

In accordance with another feature, an embodiment of the present invention includes a cold water valve fluidly and directly coupled to the cold water supply conduit downstream of the cold water pump and communicatively coupled to the electric controller, wherein the electric controller is operably configured to selectively place the cold water valve in an open position permitting the flow of the liquid housed within the cold water storage tank to the faucet.

In accordance with yet another feature, an embodiment of the present invention also includes a temperature sensor fluidly coupled to the cold water supply conduit, operably configured to detect a fluid temperature, and communicatively coupled to the electric controller, wherein the electric controller is operably configured to modulate the cold water valve to and from the open position and an at least partially closed position permitting uninhibited flow of the outside water source to the faucet dictated at least partially by the fluid temperature.

In accordance with a further feature of the present invention, the electric display is operably configured to receive a desired chill water temperature from a user and the electric controller is operably configured to modulate the cold water valve to and from the open position and the at least partially closed position dictated at least partially by the fluid temperature and the desired chill water temperature.

In accordance with an additional another feature, an embodiment of the present invention also includes an electric water heater operably configured to heat the incoming liquid from the outside water source to a temperature within a range of 120-140° F. and communicatively coupled to the electric controller and a hot water pump fluidly coupled to the electric water heater and communicatively coupled to the electric controller, wherein the electric controller is operably configured to selectively cause the hot water pump to induce a flow of heated liquid from the electric water heater and at a temperature within the range of 120-140° F. to the hot water supply conduit and out through the faucet.

In accordance with yet another feature, an embodiment of the present invention also includes a hot water valve fluidly and directly coupled to the hot water supply conduit downstream of the hot water pump and communicatively coupled to the electric controller, wherein the electric controller is operably configured to selectively place the hot water valve in an open position permitting the flow of heated liquid to the faucet.

In accordance with yet another feature, an embodiment of the present invention also includes a heat temperature sensor fluidly coupled to the hot water supply conduit, operably configured to detect a fluid temperature, and communicatively coupled to the electric controller, wherein the electric controller is operably configured to modulate the hot water valve to and from the open position and an at least partially closed position permitting uninhibited flow of the outside water source to the faucet dictated at least partially by the fluid temperature detected by the heat temperature sensor.

In accordance with a further feature of the present invention, the electric display is operably configured to receive a desired heat water temperature from the user and the electric controller is operably configured to modulate the hot water valve to and from the open position and the at least partially closed position dictated at least partially by the fluid temperature detected by the heat temperature sensor and the desired heat water temperature.

In accordance with an exemplary feature, an embodiment of the present invention also includes an electric water heater operably configured to heat the incoming liquid from the outside water source to a temperature within a range of 120-140° F. and communicatively coupled to the electric controller and a hot water pump fluidly coupled to the electric water heater and communicatively coupled to the electric controller, wherein the electric controller is operably configured to selectively cause the hot water pump to induce a flow of heated liquid from the electric water heater and at a temperature within the range of 120-140° F. to the hot water supply conduit and out through the faucet.

In accordance with yet another feature, an embodiment of the present invention also includes a hot water valve fluidly and directly coupled to the hot water supply conduit downstream of the hot water pump and communicatively coupled to the electric controller, wherein the electric controller is operably configured to selectively place the hot water valve in an open position permitting the flow of heated liquid to the faucet.

In accordance with a further feature, an embodiment of the present invention also includes a heat temperature sensor fluidly coupled to the hot water supply conduit, operably configured to detect a fluid temperature, and communicatively coupled to the electric controller, wherein the electric controller is operably configured to modulate the hot water valve to and from the open position and an at least partially closed position permitting uninhibited flow of the outside water source to the faucet dictated at least partially by the fluid temperature detected by the heat temperature sensor.

Also in accordance with the present invention, a method of inducing a cold water temperature change within a conduit assembly of a tub enclosure is disclosed that includes the steps of providing a tub enclosure having a faucet coupled to the tub enclosure, a hot water supply conduit, and a cold water supply conduit and providing a cold plunge water generation assembly with a base, a housing coupled to the base to form an enclosure, an electric display, a liquid intake connector, a cold water storage tank disposed within the enclosure, a cold water pump fluidly coupled to the cold water storage tank through a cold water assembly conduit, an electric water cooling system operably configured to chill incoming liquid from the outside water source to a temperature within a range of 33-45° F., and an electric controller communicatively coupled to the cold water pump, the electric display, and the electric water cooling system. The method also includes inducing a flow of water from an outside water source to the electric water cooling system (either before or after assembly is turned on), inserting a desired water temperature within the range of 33-45° F. into a user interface on the electric display, initiating the electric water cooling system with the electric controller and chilling the water with the electric water cooling system to the desired water temperature and transporting chilled water through the cold water assembly conduit to the cold water storage tank, and activating an activation switch on the pumping the cold plunge water generation assembly to cause the electric controller to send a signal to the cold water pump to cause pumping of the chilled water at the desired temperature from the cold water storage tank to the cold water supply conduit and out through the faucet.

In accordance with a further feature of the present invention, the activation switch is a digital icon on the user interface on the electric display.

In accordance with an exemplary feature, an embodiment of the present invention also includes positioning the cold plunge water generation assembly proximal to the tub enclosure.

In accordance with yet another feature, an embodiment of the present invention also includes activating the activation switch to cause the electric controller to send a valve signal to a cold water valve fluidly and directly coupled to the cold water supply conduit and downstream of the cold water pump, the valve signal placing the cold water valve in an open position permitting the chilled water to flow from the cold water storage tank to the cold water supply conduit and out through the faucet and restricting water flow in the cold water supply conduit from the outside water source.

In accordance with yet another feature, an embodiment of the present invention also includes sensing a fluid temperature with a temperature sensor located downstream of the cold water valve and sending another valve signal with the electric controller to the cold water valve placing the cold water valve in the open position and a closed position permitting uninhibited flow of the outside water source until the fluid temperature equals the desired water temperature.

Although the invention is illustrated and described herein as embodied in a cold plunge water generation assembly for a tub enclosure with heating capability, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic of the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the tub enclosure or, where applicable, the direction from a base of the cold plunge water generation assembly to the upper surface of the housing of the cold plunge water generation assembly.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
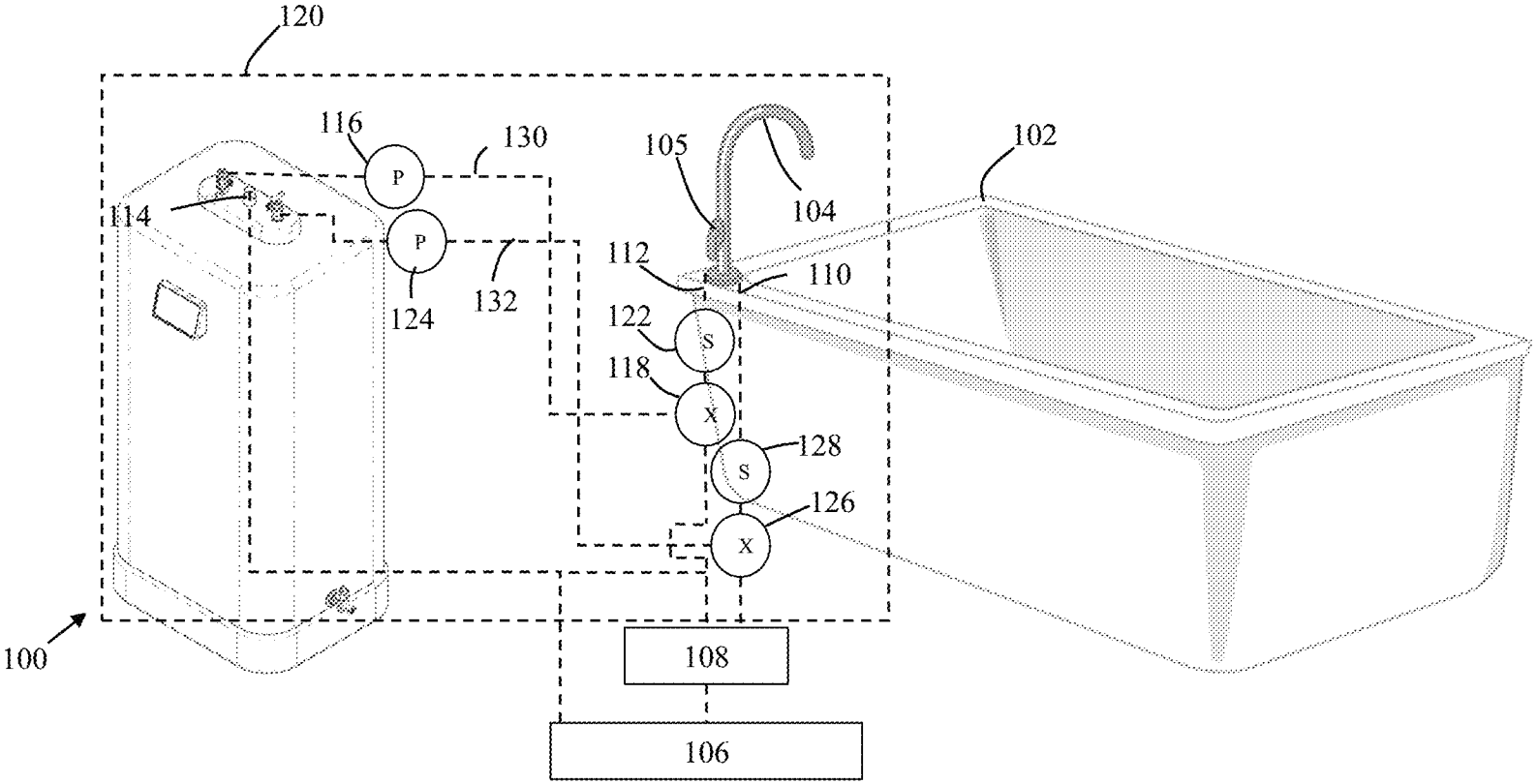
FIG. 1 is a schematic diagram depicting a cold plunge water generation assembly fluidly and mechanically coupled to a tub enclosure in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 2:
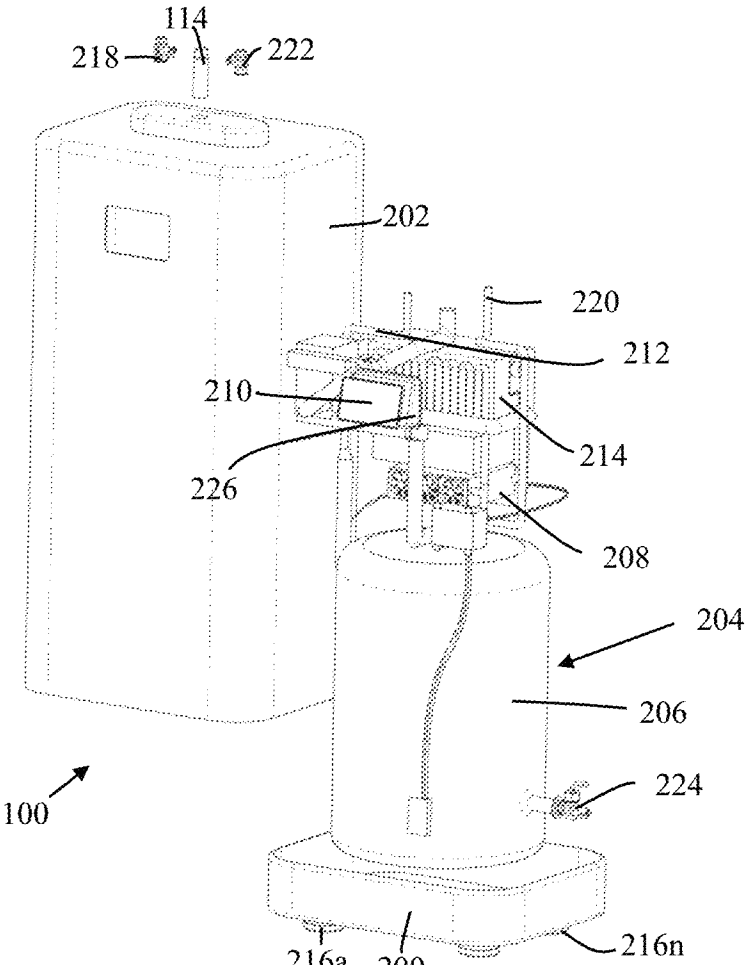
FIG. 2 is an exploded view of the cold plunge water generation assembly in FIG. 1.

The present invention provides a novel and efficient cold plunge water generation assembly for a tub enclosure that is configured to adapt to a conventional turn enclosure found in most households. Referring now to FIGS. 1-2, a schematic view and exploded view of one embodiment of the present invention is shown. FIGS. 1-2, along with the other figures herein, show several advantageous features of the present invention, but, as will be described below, the invention can be provided in several shapes, sizes, combinations of features and components, and varying numbers and functions of the components. The first example of a cold plunge water generation assembly 100 as shown in FIGS. 1-2, includes a base 200 and a housing 202 coupled to the base 200 to form an enclosure 204. The cold plunge water generation assembly 100 is preferably mobile or portable, i.e., it is not fastened to any structure and/or is less than 150 lbs, making it prone to easy transportation and portability. The cold plunge water generation assembly 100 is beneficial in that is specially designed and configured to couple with a conventional tub enclosure found in most households.

Said differently, the conventional tub enclosure 102 that is improved with the present invention typically is of a substantially rigid material, e.g., porcelain, steel, acrylic, fiberglass, cast iron, a polymer-based material, a combination of the same, etc. The tub enclosure 102 typically includes a bottom wall with a drain configured to drain incoming water to a sewage system and a sidewall that surrounds the bottom wall. The top surface of the sidewall typically includes a faucet 104 coupled thereto, wherein the faucet 104 is fluidly coupled to a plumbing conduit assembly with one or more hand-activated valves and/or levers (e.g., handle valve 105). Specifically, the plumbing conduit assembly typically includes a hot water supply conduit 110 configured to fluidly couple the faucet 104 to an outside water source 106 (e.g., city/well water) and a heat exchange assembly 108. The plumbing conduit assembly also typically includes a cold water supply conduit 112 configured to fluidly couple the outside water source 106 and the faucet 104 together. The hot water supply conduit 110 is typically directly coupled to a heat exchange assembly 108, e.g., solar heater, electric water heater, fossil fuel heater, instant heater, storage tank, etc. The plumbing conduit assembly may also typically include conduit with one or more isolation valves that are configured to cutoff supply of the outside water source 106 to the faucet in the case of an emergency.

FIGS. 1-2 will also be described in conjunction with a process of inducing a cold water temperature change within a conduit assembly of the tub enclosure 102, i.e., a process of adapting a conventional tub enclosure as a cold plunge. Although a specific order of executing the process will be described and/or shown, the order of executing the steps may be changed relative to the order shown in certain embodiments. Also, two or more steps described or shown in succession may be executed concurrently or with partial concurrence in some embodiments. Certain steps may also be omitted for the sake of brevity. In some embodiments, some or all of the process steps can be combined into a single process.

Figure 3:
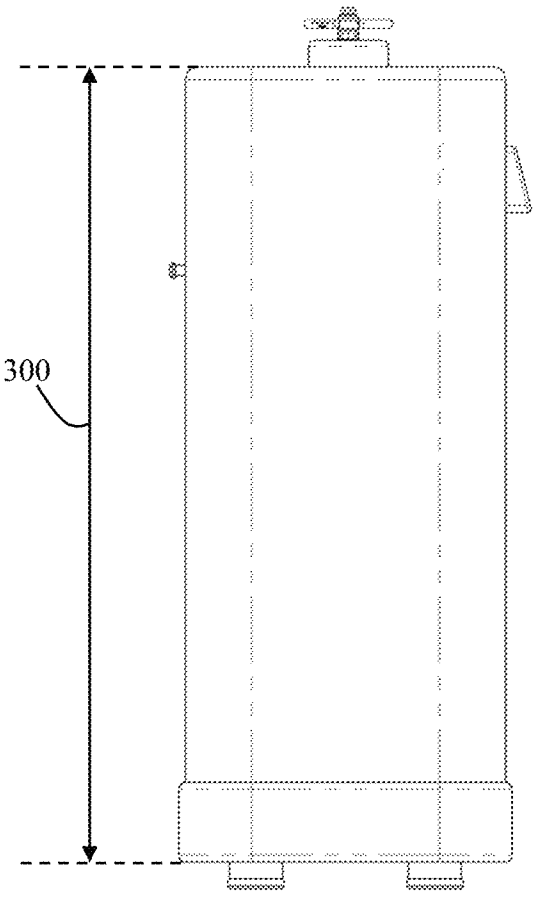
Figure 6:
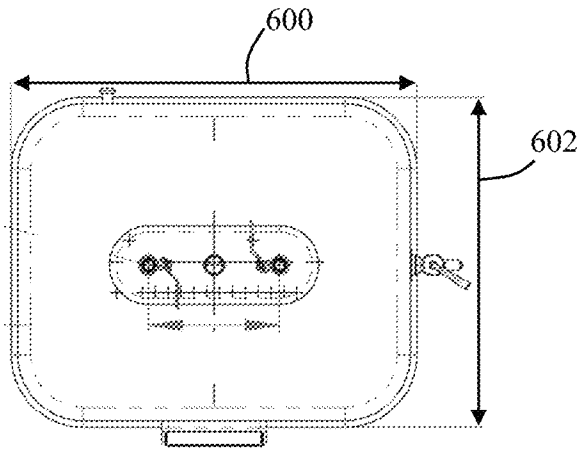
FIG. 6 is a top plan view of the cold plunge water generation assembly in FIG. 1.
Figure 5:
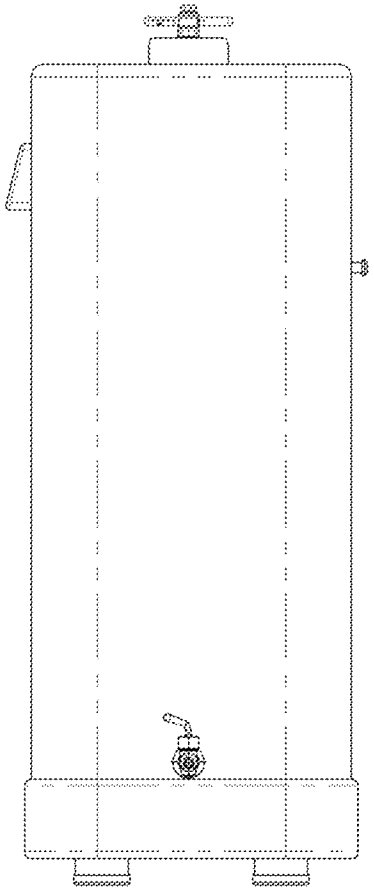

The first step in the process may include providing a tub enclosure 102 having a faucet 104 coupled to the tub enclosure 102, a hot water supply conduit 110, and a cold water supply conduit 112 and providing the cold plunge water generation assembly 100 described herein. The base 200 and housing 202 of the cold plunge water generation assembly 100 may be coupled together in a watertight configuration using one or more seals, fasteners, or snap-fit edges. The housing 202 and base 200 are preferably of a substantially rigid material, e.g., PVC plastic or other lightweight polymer. The base 200 beneficially includes one or more legs 216*a-n* (wherein "n" represents any number greater than one) with rubber, TPR, or other friction-inducing material that inhibits movement of the assembly 100 when in use and because the assembly 100 is not permanently attached to a separate structure. The enclosure 204 defined by the coupling of the base 200 and the housing 202 may be a volume approximately equal to the height 300 (e.g., 140-180 cm) depicted in FIG. 3 and area defined by the width 600 (e.g., 60-90 cm) and length 602 (e.g., 40-80 cm) depicted in FIG. 6.

The assembly 100 includes a liquid intake connector 114 (e.g., copper conduit, quick connect fitting, etc.) that is fluidly coupled (directly or indirectly) to the outside water source 106. The liquid intake connector 114 provides access to the conduit in the assembly 100 from the outside water source 106, wherein the liquid or water coming to the intake connector 114 may pass through the heat exchange assembly 108 before reaching the intake connector 114. The assembly 100 also includes a cold water storage tank 206, a cold water pump 116 fluidly coupled to the cold water storage tank 206 through a cold water assembly conduit 212. The cold water assembly conduit 212, like other conduit used in the assembly 100 may be of a copper material, polymeric material, etc. The assembly 100 also includes an electric evaporator-based water cooling system 208 operably configured to chill incoming liquid from the outside water source 106 to a temperature within a range of 33-45° F., which is the desired range for cold plunging by most consumers. The water storage tank 206 is disposed within the enclosure 204 and configured to house a liquid therein, e.g., water incoming from the outside water source 106 after it is processed by the electric evaporator-based water cooling system 208 which may be powered by 120-240V directly from the structure's or building's power source. The electric water cooling system 208, or refrigeration circuit, may also utilize a compressor that is centrifugal, screw-based, scroll, or reciprocating. The electric water cooling system 208 may also be vapor-compression or vapor-absorption based.

The water storage tank 206 and conduit inside of the assembly 100 are preferably insulated to reduce heat transfer to the chilled water inside of the water storage tank 206. The storage tank 206 may also include drain or plug 224 for evacuating housed and stored liquid, cleaning, etc. The housing 202 may also include one or more cutouts shaped and sized to receive the drain 224 so the user can quickly access the drain valve if needed.

The assembly 100 also includes an electric display 210 configured to display information and receive information. The assembly 100 also includes an electric controller 120 communicatively coupled to the cold water pump 116, the electric water cooling system 208, and the electric display 210. With reference to FIG. 2, the dashed line represents a communicatively coupled configuration, wherein communication may be wired or wireless-based but otherwise enables information and/or signals to pass from one electrical component to another. The electric controller 120 is operably configured to selectively initiate the water cooling system 208 to chill incoming liquid for storage in the cold water storage tank 206 and cause the cold water pump 116 to induce a flow of the liquid housed within the cold water storage tank 206 and at the temperature range of 33-45° F. to the cold water supply conduit 112 and out through the faucet 104. Said another way, when desired by the user, the assembly 100 will cause already chilled water to flow from the storage tank 206 through the cold water assembly conduit 212, which may also be coupled to a connector 218, to the cold water conduit 130 outside of the housing 202 that is coupled directly to the cold water assembly conduit 212 for delivery to the faucet 104 and tub enclosure 102. Said process and system beneficially enables quick and efficient access to a cold plunge environment using a conventional tub enclosure 102. To that end, the cold plunge water generation assembly 100 is disposed proximal to the tub enclosure 102, i.e., near or within 6-12 ft (or within 2-4 m), unlike most if not all known assemblies. Said differently, the tub enclosure 102 the assembly 100 is configured to be utilized with is permanently fastened to the floor of the structure or building, e.g., with caulking, adhesive sealant, tile, etc.

Said differently, the cold-water system 100 is configured to fluidly and mechanically couple with plumbing for a user's bath and that is configured to selectively cool water incoming into the bathtub to temperatures within a range of 33-45° F., thereby enabling a user's bathtub to work as an ice bath/cold water plunge. The storage tank 206 is shaped and sized to house approximately 30-120 gallons of chilled water that will be dispensed instantly into the plumbing into the user's bath on demand and refill off city/well water as it is dispensed. The assembly 100 may include one or more valve(s) and internal sensor(s) capable of detecting the temperature of the water downstream of the storage tank 206, wherein a temperature of the chilled water not within the desired temperature of the user may be stopped with a valve and recirculated back to the electric water cooling system 208 for continued chilling before transportation to the faucet 104.

The assembly 100 or electric display 210 may include a temperature control feature (e.g., a dial thermometer), whereby the temperature of the incoming water may be selectively modulated according to the desired preferences of the user. The electronic display 210 is adapted to be received within a cutout on the housing 202 and is configured to display a user interface for receiving input from the user, e.g., haptically. Specifically, the user interface may be operable to display one or more digital icons for manipulation by the user, e.g., for controlling temperature, flow rate, volume emitted, etc. Therefore, the user can select and/or readily ascertain the temperature and amount of cold water dispensed from the assembly 100 (e.g., 60 gallons at 30° F.). Said differently, it is important that the storage tank 206 is capable of holding enough chilled water to enable the tub enclosure 106 to be substantially filled (e.g., 90%) such that the cold plunge is effectively reached by most of the user's body, wherein most convention tub enclosures hold 40-70 gallons of water before the water overflows over an upper edge thereon. In one embodiment, the assembly 100 utilizes a dial thermometer having a metal pointer on a circular scale to indicate temperature measurements and has two main components: a needle and a temperature sensor. The temperature control feature may also comprise a remote that is connected to the assembly 100 that toggles the temperature up and down. Furthermore, the electric controller 120 may also be communicatively coupled to a software application downloadable and/or executable by a user's electronic device, wherein the software application may enable the user to remotely modify the temperature and amount of chilled water dispensed. To that end, the electronic controller 120 may also include a network adapter enabling the assembly 100 to couple with the user's electronic device over a network (e.g., the Internet).

In one embodiment, the assembly 100 also includes a cold water valve 118 fluidly and directly coupled to the cold water supply conduit 112 downstream of the cold water pump 116 and that is also communicatively coupled to the electric controller 120. The electric controller 120 may be operably configured to selectively place the cold water valve 118 in an open position permitting the flow of the liquid housed within the cold water storage tank 206 to the faucet 104. The open position may include only permitting the chilled water from the storage tank 206 to flow to the faucet 104 and not from, for example, water directly from the outside water source 106 or water directly from the heat exchanger 108.

The assembly 100 may also include a temperature sensor 122 fluidly coupled to the cold water supply conduit 112 downstream of the water storage tank 206, operably configured to detect a fluid (e.g., liquid) temperature, and that is communicatively coupled to the electric controller 120. The electric controller 120 is beneficially operably configured to modulate the cold water valve 118 to and from the open position and an at least partially closed position that permits uninhibited flow of the outside water source 106 to the faucet 104 dictated at least partially by the fluid temperature. The term "uninhibited" means not water not passing through the assembly 100, particularly water that is chilled. Said differently, the assembly 100 is configured to permit water from the outside water source 106 and/or heat exchanger 108 to enable the water reaching the faucet to the temperature desired by the user. As the liquid coming from the outside water source 106 and/or heat exchanger 108 is typically higher than the chilled water, this feature would likely only be implemented when the sensed fluid temperature is lower than the temperature desired by the user. Said another way, the electric display 210 is operably configured to receive a desired chill water temperature from a user. The electric controller 120 may then be operably configured to modulate the cold water valve 118 to and from the open position and the at least partially closed position dictated at least partially by the fluid temperature and the desired chill water temperature.

While the assembly 100 is beneficially configured to emulate a cold plunge environment for a user, the assembly 100 also includes an electric water heater 214 operably configured to heat the incoming liquid from the outside water source 106 to a temperature within a range of 120-140° F. for delivery to the faucet 104. Water heated by the water heater 214 may be utilized by the user independent of the chilled water (preferably on demand) or utilized by the assembly 100 to generate the chilled temperature desired by the user. The water incoming to the intake connector 114 and conduit may be transported to the water heater 214 and then delivered to the conduit 220, connector 222, and outside conduit 132 that is directly and fluidly coupled to the hot water supply conduit 110 for delivery to the faucet 104 and tub enclosure 102.

The electric water heater 214 is also communicatively coupled to the electric controller 120 for modulation electronically. The assembly may also include a hot water pump 124 fluidly coupled to the electric water heater 214 and communicatively coupled to the electric controller 120, wherein the electric controller 120 is operably configured to selectively cause the hot water pump 124 to induce a flow of heated liquid from the electric water heater 214 and at a temperature within the range of 120-140° F. to the hot water supply conduit 110 and out through the faucet 104. The hot or cold temperature value of the water may also be selectively modified by the user. To effectuate transportation of the water from the assembly 100 to the faucet 104, a hot water valve 126 that is fluidly and directly coupled to the hot water supply conduit 110 downstream of the hot water pump 124 may be utilized. The hot water valve 126 is communicatively coupled to the electric controller 120 and the electric controller 120 is operably configured to selectively place the hot water valve 126 in an open position permitting the flow of heated liquid directly to the faucet 104.

Similar to the cold temperature sensor 122, a heat temperature sensor 128 may be fluidly coupled to the hot water supply conduit 112 downstream of the water heater 214 and is operably configured to detect a fluid temperature in the conduit. The heat temperature sensor 128 is communicatively coupled to the electric controller 120 that may be operably configured to modulate the hot water valve 126 to and from the open position and an at least partially closed position permitting uninhibited flow of the outside water source 106 to the faucet 104 dictated at least partially by the fluid temperature detected by the heat temperature sensor 128.

Figure 4:
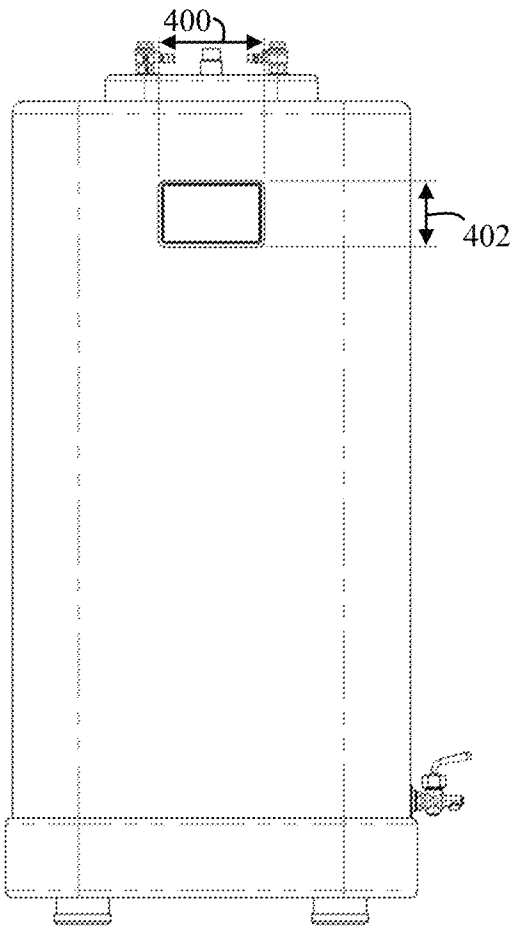
FIGS. 3-5 are elevational left, front, and right-side views of the cold plunge water generation assembly in FIG. 1.

The electric display 210 may also include a housing 226 that includes a width 400 and length 402 (as depicted in FIG. 4) configured to be received within a cutout of the housing 202. The electric display 210 is operably configured to receive a desired heat water temperature from the user and the electric controller 120 is operably configured to modulate the hot water valve 126 to and from the open position and the at least partially closed position dictated at least partially by the fluid temperature detected by the heat temperature sensor 128 and the desired heat water temperature. The electric water heater 214 is beneficially and operably configured to heat the incoming liquid from the outside water source 106 to a temperature within a range of 120-140° F. without having to have the outside water passing through the heat exchanger 108. The electric water heater 214 is communicatively coupled to the electric controller 120, wherein a hot water pump 124 that is fluidly coupled to the electric water heater 214 and communicatively coupled to the electric controller 120, induces a flow of heated liquid from the electric water heater 214 and at a temperature within the range of 120-140° F. to the hot water supply conduit 110 and out through the faucet 104. The electric controller 120 is operably configured to selectively cause the hot water pump 124 to induce the flow, i.e., turn on, by sending a wired or wireless signal to the pump 124.

In further embodiments, the system and assembly 100 includes a hot water valve 126 fluidly and directly coupled to the hot water supply conduit 110 downstream of the hot water pump 124 and that is also communicatively coupled to the electric controller 120. The electric controller 120 is then operably configured to selectively place the hot water valve 126 in an open position permitting the flow of heated liquid to the faucet 104. Additionally, a heat temperature sensor 128 fluidly coupled to the hot water supply conduit 112, operably configured to detect a fluid temperature, and communicatively coupled to the electric controller 120. The electric controller 120 is operably configured to modulate the hot water valve 126 to and from the open position and an at least partially closed position permitting uninhibited flow of the outside water source 106 to the faucet 104 dictated at least partially by the fluid temperature detected by the heat temperature sensor 128.

A cold plunge water generation assembly for a tub enclosure and process for creating a cold plunger environment has been disclosed that beneficially enables users to emulate a cold plunge environment with their conventional tub enclosure and in a cost-effective and time-effective manner. Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. In combination with a tub enclosure having a faucet coupled to the tub enclosure, an outside water source, a heat exchange assembly, a hot water supply conduit configured to fluidly couple the outside water source, the heat exchange assembly, and the faucet together, and a cold water supply conduit configured to fluidly couple the outside water source and the faucet together, the improvement comprising:

a cold plunge water generation assembly with a base, with a housing coupled to the base to form an enclosure, with a liquid intake connector fluidly coupled to the outside water source, with a cold water storage tank disposed within the enclosure and configured to house a liquid therein, with a cold water pump fluidly coupled to the cold water storage tank through a cold water assembly conduit, with an electric water cooling system operably configured to chill incoming liquid from the outside water source to a temperature within a range of 33-45° F., with an electric display, a cold water valve fluidly and directly coupled to the cold water supply conduit downstream of the cold water pump and communicatively coupled to the electric controller, and with an electric controller communicatively coupled to the cold water valve, the cold water pump, the electric water cooling system, and the electric display, wherein the electric controller is operably configured to selectively initiate the water cooling system to chill incoming liquid for storage in the cold water storage tank and cause the cold water pump to induce a flow of the liquid housed within the cold water storage tank and at the temperature range of 33-45° F. to the cold water supply conduit and to the cold water valve configured to be placed in an open position by the electronic controller permitting the flow of the liquid housed within the cold water storage tank to and out through the faucet.

2. The improvement according to claim 1, wherein the cold plunge water generation assembly is disposed proximal to the tub enclosure.

3. The improvement according to claim 1, further comprising:

a temperature sensor fluidly coupled to the cold water supply conduit, operably configured to detect a fluid temperature, and communicatively coupled to the electric controller, wherein the electric controller is operably configured to modulate the cold water valve to and from the open position and an at least partially closed position permitting uninhibited flow of the outside water source to the faucet dictated at least partially by the fluid temperature.

4. The improvement according to claim 3, wherein the electric display is operably configured to receive a desired chill water temperature from a user and the electric controller is operably configured to modulate the cold water valve to and from the open position and the at least partially closed position dictated at least partially by the fluid temperature and the desired chill water temperature.

5. The improvement according to claim 4, further comprising:

an electric water heater operably configured to heat the incoming liquid from the outside water source to a temperature within a range of 120-140° F. and communicatively coupled to the electric controller; and a hot water pump fluidly coupled to the electric water heater and communicatively coupled to the electric controller, wherein the electric controller is operably configured to selectively cause the hot water pump to induce a flow of heated liquid from the electric water heater and at a temperature within the range of 120-140° F. to the hot water supply conduit and out through the faucet.

6. The improvement according to claim 5, further comprising:

a hot water valve fluidly and directly coupled to the hot water supply conduit downstream of the hot water pump and communicatively coupled to the electric controller, the electric controller operably configured to selectively place the hot water valve in an open position permitting the flow of heated liquid to the faucet.

7. The improvement according to claim 6, further comprising:

a heat temperature sensor fluidly coupled to the hot water supply conduit, operably configured to detect a fluid temperature, and communicatively coupled to the electric controller, wherein the electric controller is operably configured to modulate the hot water valve to and from the open position and an at least partially closed position permitting uninhibited flow of the outside water source to the faucet dictated at least partially by the fluid temperature detected by the heat temperature sensor.

8. The improvement according to claim 7, wherein the electric display is operably configured to receive a desired heat water temperature from the user and the electric controller is operably configured to modulate the hot water valve to and from the open position and the at least partially closed position dictated at least partially by the fluid temperature detected by the heat temperature sensor and the desired heat water temperature.

9. The improvement according to claim 1, further comprising:

an electric water heater operably configured to heat the incoming liquid from the outside water source to a temperature within a range of 120-140° F. and communicatively coupled to the electric controller; and a hot water pump fluidly coupled to the electric water heater and communicatively coupled to the electric controller, wherein the electric controller is operably configured to selectively cause the hot water pump to induce a flow of heated liquid from the electric water heater and at a temperature within the range of 120-140° F. to the hot water supply conduit and out through the faucet.

10. The improvement according to claim 9, further comprising:

a hot water valve fluidly and directly coupled to the hot water supply conduit downstream of the hot water pump and communicatively coupled to the electric controller, the electric controller operably configured to selectively place the hot water valve in an open position permitting the flow of heated liquid to the faucet.

11. The improvement according to claim 10, further comprising:

a heat temperature sensor fluidly coupled to the hot water supply conduit, operably configured to detect a fluid temperature, and communicatively coupled to the electric controller, wherein the electric controller is operably configured to modulate the hot water valve to and from the open position and an at least partially closed position permitting uninhibited flow of the outside water source to the faucet dictated at least partially by the fluid temperature detected by the heat temperature sensor.

12. A method of inducing a cold water temperature change within a conduit assembly of a tub enclosure comprising the steps of:

providing a tub enclosure having a faucet coupled to the tub enclosure, a hot water supply conduit, and a cold water supply conduit;

providing a cold plunge water generation assembly with a base, a housing coupled to the base to form an enclosure, an electric display, a liquid intake connector, a cold water storage tank disposed within the enclosure, a cold water pump fluidly coupled to the cold water storage tank through a cold water assembly conduit, a cold water valve fluidly and directly coupled to the cold water supply conduit and downstream of the cold water pump, an electric water cooling system operably configured to chill incoming liquid from an outside water source to a temperature within a range of 33-45° F., and an electric controller communicatively coupled to the cold water pump, the electric display, and the electric water cooling system;

inducing a flow of water from the outside water source to the electric water cooling system;

inserting a desired water temperature within the range of 33-45° F. into a user interface on the electric display;

initiating the electric water cooling system with the electric controller and chilling the water with the electric water cooling system to the desired water temperature and transporting chilled water through the cold water assembly conduit to the cold water storage tank; and activating an activation switch on the electric controller to send:

a signal to the cold water pump to cause pumping of the chilled water at the desired temperature from the cold water storage tank to the cold water supply conduit and to the cold water valve; and a valve signal to the cold water valve placing the cold water valve in an open position permitting chilled water to flow from the cold water storage tank, through the cold water supply conduit, through the cold water valve, and out through the faucet without water flow in the cold water supply conduit directly from the outside water source through the faucet.

13. The method according to claim 12, wherein the activation switch is a digital icon on the user interface on the electric display.

14. The method according to claim 12, further comprising:

positioning the cold plunge water generation assembly proximal to the tub enclosure.

15. The method according to claim 12, further comprising:

sensing a fluid temperature with a temperature sensor located downstream of the cold water valve and sending another valve signal with the electric controller to the cold water valve placing the cold water valve in the open position and a closed position permitting uninhibited flow of the outside water source until the fluid temperature equals the desired water temperature.

* * * * *